US005110096A

United States Patent [19]

Zacharias

[11] Patent Number: 5,110,096

[45] Date of Patent: May 5, 1992

[54] ONE-PIECE TUNDISH LINING

[75] Inventor: Donald R. Zacharias, Parma Heights, Ohio

[73] Assignee: Foseco International Limited, Birmingham, England

[21] Appl. No.: 655,507

[22] Filed: Feb. 15, 1991

[51] Int. Cl.[5] ..... C21B 7/14

[52] U.S. Cl. ..... 266/227; 266/275/286

[58] Field of Search ..... 222/591; 266/227, 275, 266/280, 286

[56] References Cited

U.S. PATENT DOCUMENTS

| | | | |
|---|---|---|---|
| 4,012,029 | 3/1977 | Seguin et al. | 266/275 |
| 4,022,358 | 5/1977 | Courtenay | 222/607 |
| 4,042,229 | 8/1977 | Eccleston | 266/275 |
| 4,043,543 | 8/1977 | Courtenay et al. | 266/275 |
| 4,048,134 | 9/1977 | Courtenay et al. | 260/38 |
| 4,055,336 | 10/1977 | Massin | 266/283 |
| 4,076,224 | 2/1978 | Duchateau | 266/275 |
| 4,126,301 | 11/1978 | Massin | 266/280 |
| 4,158,939 | 6/1979 | Massin | 52/593 |
| 4,165,026 | 8/1979 | Hazlehurst et al. | 222/591 |
| 4,194,730 | 3/1980 | Matsumoto et al. | 266/275 |
| 4,330,107 | 5/1982 | Lynham | 266/44 |
| 4,993,692 | 2/1991 | Brown et al. | 266/275 |

*Primary Examiner*—Scott Kastler
*Attorney, Agent, or Firm*—Nixon & Vanderhye

[57] ABSTRACT

A preformed expendable lining of high density, erosion resistant, castable refractory material is provided for a metallurgical vessel, such as a tundish. The lining is integrally formed in one piece and has a floor, walls, and at least one integrally formed flow control device. The flow control device may comprise a pair of upright baffles with apertures (some of them angled to the horizontal) for the passage of molten metal; or may comprise dams and weirs. The lining is particularly useful for the pour area of a T-shaped tundish, or a similar area for a conventional trough shaped tundish.

23 Claims, 8 Drawing Sheets

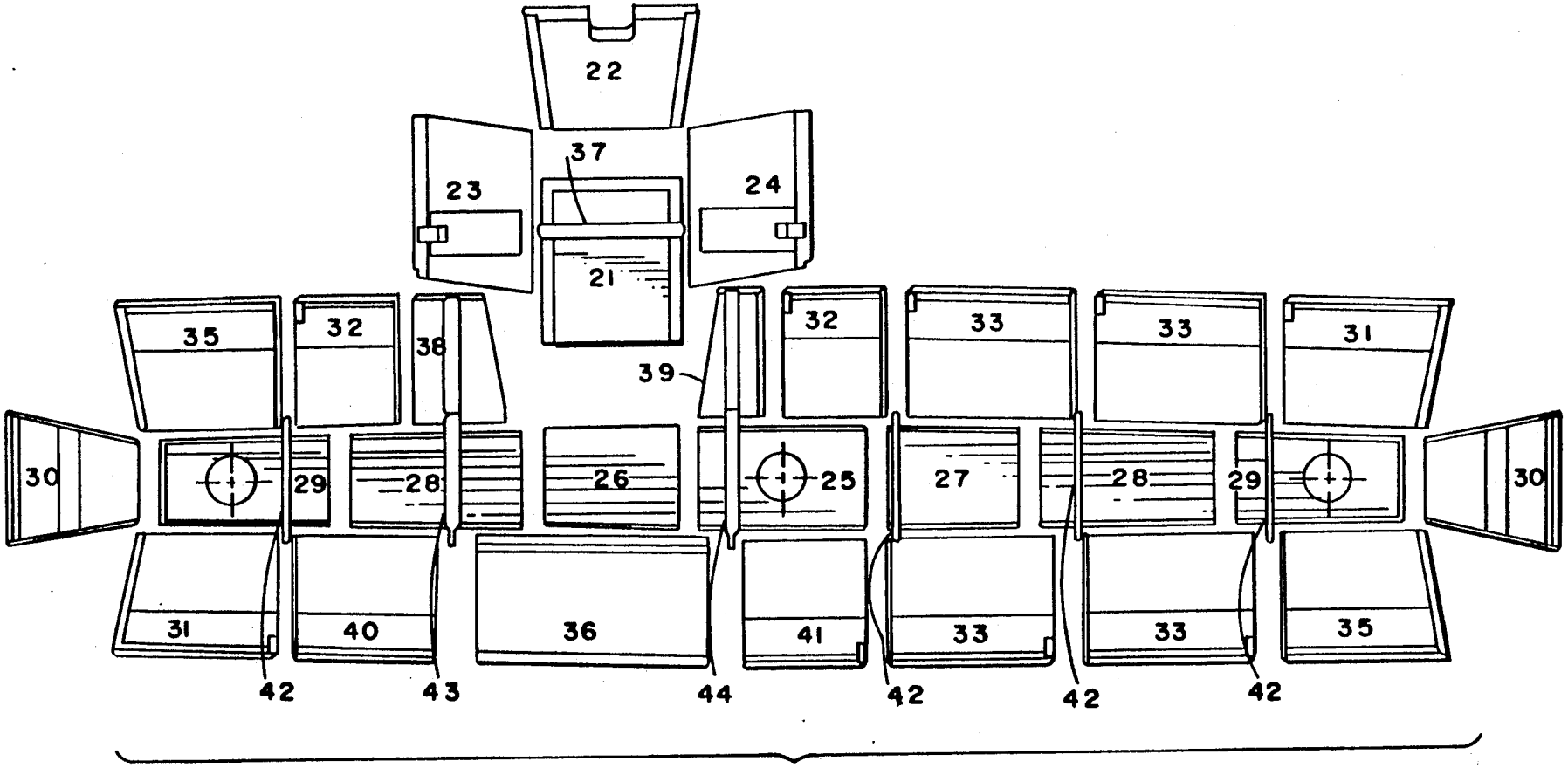
FIG. 5A - PRIOR ART

FIG. 9A
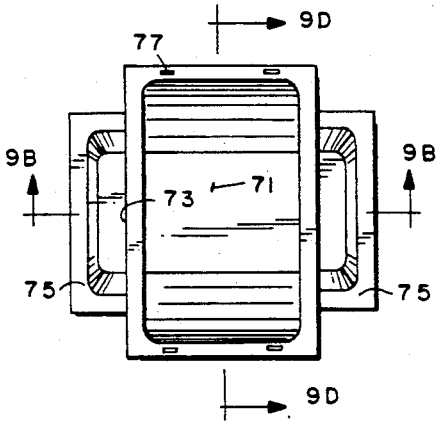
FIG. 9B
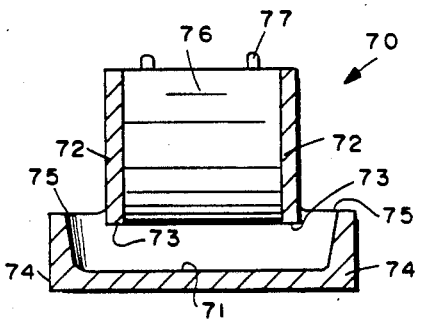
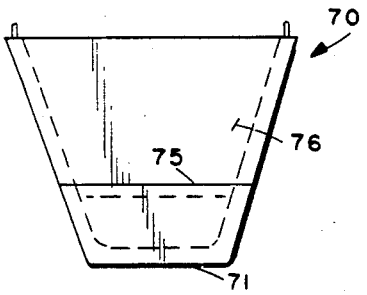
FIG. 9C
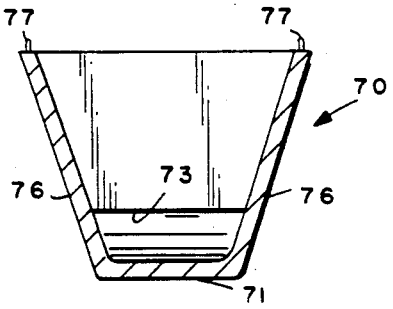
FIG. 9D
FIG. 10
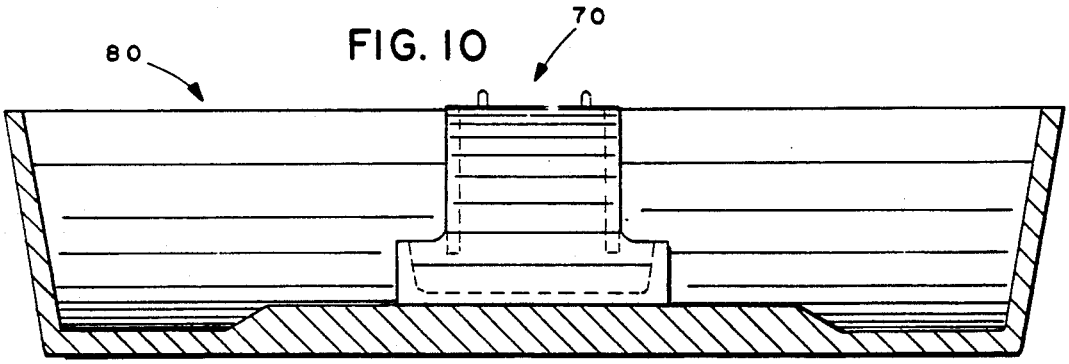

ONE-PIECE TUNDISH LINING

BACKGROUND AND SUMMARY OF THE INVENTION

This invention relates to the provision in a metallurgical vessel, e.g. a tundish, of refractory linings and flow control devices.

It is well known to line tundishes and the like with a permanent lining of refractory material, e.g. refractory brick, adjacent the metal casing of the tundish and an expendable inner lining of refractory, heat-insulation material. This expendable lining is normally applied in slab or sheet form, the slabs being introduced to form to the floor and walls of the tundish. [See, for example, U.S. Pat. Nos. 4,012,029; 4,022,358; 4,042,229; 4,043,543; 4,048,134; 4,245,761; 4,330,107; 4,055,336; 4,076,224; 4,126,301; 4,158,939; 4,165,026; and 4,194,730.] Such a lining for a typical tundish, which may have a capacity of from 2 to 80 tons of molten metal, is usually applied in a number of separate, preformed pieces that have been designed to fit the specific tundish being lined. Twenty or thirty or more separate pieces of lining may have to be fitted and their joints carefully sealed to prevent penetration of the molten metal between the lining and the metal casing of the tundish.

In addition to the large number of expendable lining pieces requiring to be assembled in the tundish, it is frequently necessary to incorporate various flow control devices, including dams, weirs and baffles to direct the flow of molten metal and to create whatever conditions of change of direction and turbulence that may be deemed desirable in a particular tundish.

It has also been proposed to apply the expendable lining as a one-piece integral unit by spraying a suitable composition onto the tundish floor and walls and allowing it to dry. Although this eliminates a lot of the labor-intensive assembly of the preformed shapes, such integrally-formed linings still cannot eliminate the need for separate assembly of the various flow control devices and erosion resistant slabs.

The present invention aims to provide advantages of both of the aforementioned types of linings and to reduce or eliminate the need for separate assembly of the flow control devices and erosion resistant slabs.

In one aspect, therefore, the invention provides a preformed expendable lining for at least a portion of a metallurgical vessel, the lining being integrally formed in one-piece and having a floor portion, wall portions and at least one integrally-formed flow control device.

The lining of the invention may be formed to line a part only of the vessel, hereafter referred to for convenience as the tundish. It is of particular value for so-called T-shaped tundishes (in which when viewed in plan, the cross-bar or top of the "T" corresponds to the main body of the tundish and so is of greater length than the tail or vertical of the "T"). The area inside the tundish in the region of the junction of the cross-bar and tail of the "T" is usually the pour area where molten steel is introduced into the tundish. This region, therefore, normally has a special erosion-resistant impact pad on the floor, and the side walls have erosion resistance and it is often desirable for some of the required flow control devices to be positioned as closely adjacent to this region as possible (e.g. the erosion resistant side walls).

In transverse cross-section both the "crossbar" and the "tail" sections or body of the tundish normally are of frusto-conical shape with the walls sloping outwardly as they rise from the floor. It is frequently desired to position upright, i.e. substantially vertically-extending transverse baffles of sufficient height to extend a considerable way up the walls of the tundish. Such baffles take the form of substantially planar slabs of similar or the same erosion-resistant material as the expandable linings and are provided with a series of through apertures or holes to allow molten metal to pass down the tundish. The positioning of such baffles and the size and spacing of their apertures are carefully arranged to control the metal flow, as is well known in the art.

Thus, it is frequently desirable to position a pair of such transverse baffles across the main body of the tundish, one on each side of the T-junction region but as close as possible to (and, of course, substantially parallel to) each of the walls defining the "tail" of the T-piece. Because of the angled nature of the walls of the tundish, it has conventionally been necessary to fix these vertical baffles at some distance from the T-junction. This results in the formation of a corner around which metal must flow to pass along the main body of the tundish. The expendable linings at such corners are necessarily subject to very severe erosion. The present invention enables such corners to be eliminated.

Accordingly, in another aspect, therefore, the invention provides a preformed lining for the pour region of a tundish, the lining being integrally-formed in one piece to include a floor corresponding to the pour region, walls corresponding to two opposed walls of the tundish in the pour region and at least one flow control device extending substantially at right angles to the said opposed walls.

In a specific preferred embodiment, the integral lining defines the pour region at the T-junction and comprises a floor portion and four walls, a first wall corresponding to the base of the tail of the "T", a second wall correspond to the portion of tundish wall directly opposed to the first wall, and third and fourth walls facing each other and extending between the first and second walls, the third and fourth walls having baffle portions which are provided with an arrangement of holes, the baffle portions extending across the transverse width of the main length of the tundish.

The invention, therefore, has considerable advantages over known linings and, moreover, offers unexpected advantages to outweigh what might be perceived as series disadvantages in such a one piece preform. Clearly, there are advantages in the reduction of the number of shapes that have to be positioned and sealed. For example, in the pour area of a typical tundish, a single preformed piece of the present invention can replace, say, eight or ten conventional wall and floor shapes plus two or more flow control devices. Human error can, thereby, be reduced and the risk of a faulty fitting or sealing greatly reduced. The likelihood of molten metal penetrating a joint and leaking and of a shape being "floated away" by the molten metal is, thereby, eliminated or great reduced.

Nevertheless, the proposed use of an integrally-formed unit might well be thought disadvantageous. Such a product is a large, three-dimensional, relatively fragile object whose storage, transportation and fitment would, apparently, be more difficult and troublesome than for a number of individual relatively planar pieces.

However, the further advantages particularly to be obtained from the integral-forming of the lining with the flow control devices for the pour area of a T-shaped tundish, as indicated above, will be further described below with reference to the drawings.

The material from which the one-piece lining with flow control device(s) of the invention may be formed are any suitable materials such as those conventionally used to line a tundish, i.e. based on mixtures of refractory fibers, alumina silica aggregates and calcium aluminate cement or other fillers and binders.

For example, calcium silicate or aluminum silicate fibers; silica, alumina, magnesia and refractory silicate fillers; and colloidal silica sol, starch, phenol-formaldehyde resin and urea-formaldehyde resin binders, mulcoa grains, bauxite or alumina aggregates may be used in combination with fines of fumed silicia and alumina with a calcium aluminate cement or other compatible binder systems. Mixtures of magnesia and particulate olivine are particularly useful refractory fillers. In a preferred embodiment, the one-piece lining is formed of 60–70% alumina, low moisture, low cement, high density, castable refractory material.

The devices can conveniently be cast into one-piece form from a slurry or a vibratable castable of the desired materials. Where the flow control devices are baffles with holes through which the molten metal in the tundish is intended to flow, the holes may be integrally-formed during the casting process by the incorporation of suitable pins or blanks in the positions corresponding to the holes. Alternatively, they may be cut or punched in the formed baffle.

According to another aspect of the present invention, there is provided a combination of a trough shaped tundish having a pour area and a lining. The lining is integrally formed of refractory material and comprises a floor portion and walls, and at least one flow control device (e.g. baffle, dam, or weir) built integrally therein, the lining being dimensioned to fit within the trough shaped tundish covering the pour area with the flow control devices controlling flow from the preformed lining to other areas of the tundish not lined by the preformed lining.

It is the primary object of the present invention to provide for the simple and effective lining of a metallurgical vessel with expendable material, particularly the pour area of a tundish. This and other objects of the invention will become clear from an inspection of the detailed description of the invention, and from the appended claims.

BRIEF DESCRIPTION OF THE DRAWINGS

FIG. 5A shows the prior art assembly of pieces needed to line the tundish of FIG. 1 by conventional means;

FIGS. 9A–9D illustrate a second embodiment of an integrally-formed lining according to the invention, FIG. 9A is a top plan view, FIG. 9B a longitudinal cross-sectional view, FIG. 9C an end view, and FIG. 9D a cross-sectional view taken along lines 9D—9D of FIG. 9A; and FIG. 10 is a longitudinal cross-sectional view of a trough tundish showing an exemplary position of an integrally-formed lining according to FIG. 9 therein.

DETAILED DESCRIPTION OF THE DRAWINGS

In FIGS. 1 to 4, a tundish 10 is of T-shape, the main body 11 of the tundish corresponding to the cross-bar of the "T" and being defined by longitudinal walls 11A and 11B and end walls 11C and 11D. A shorter tail portion 12 of the "T" is defined by walls 12A and 12B extending substantially at right angles from wall 11B and wall 12C extending substantially parallel to wall 11B. Pour region 13 is located in the region at the junction of the main body and tail portion.

Figure 1:
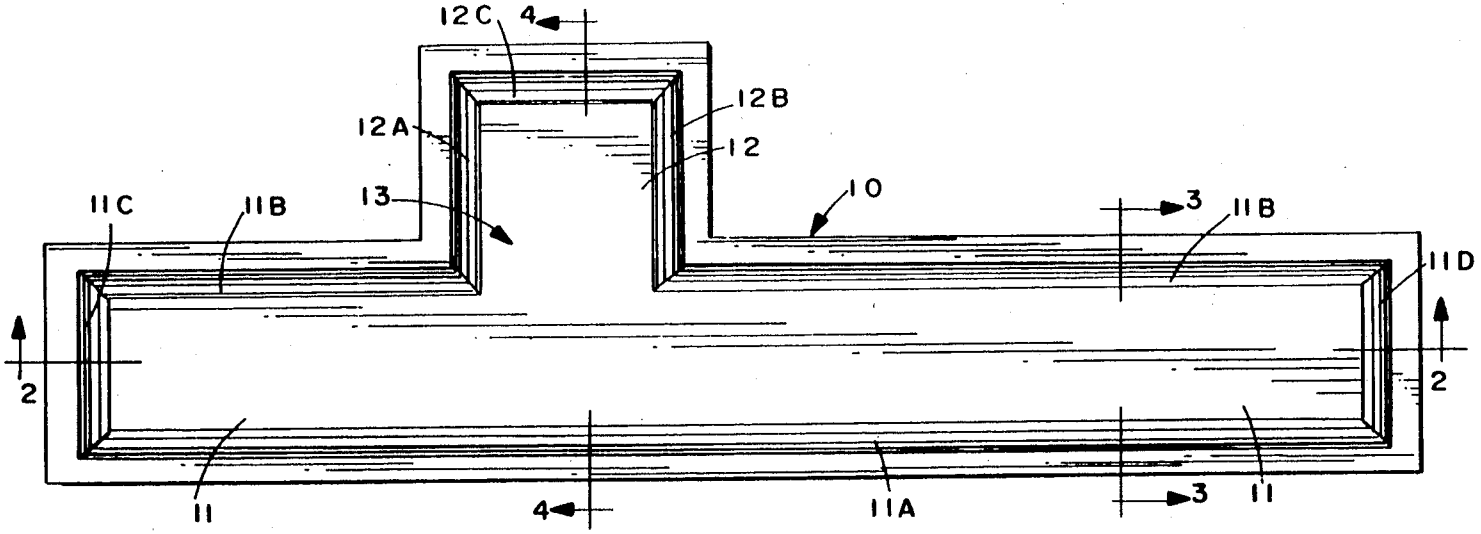
FIG. 1 is a plan view of a tundish to be lined according to the invention.
Figure 2:
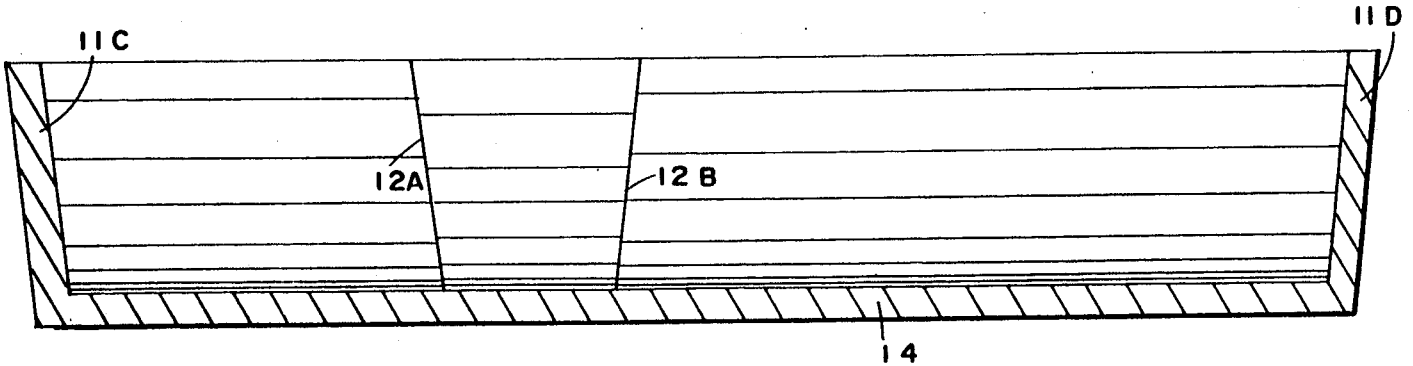
FIG. 2 is a section on line II—II of FIG. 1.
Figure 4:
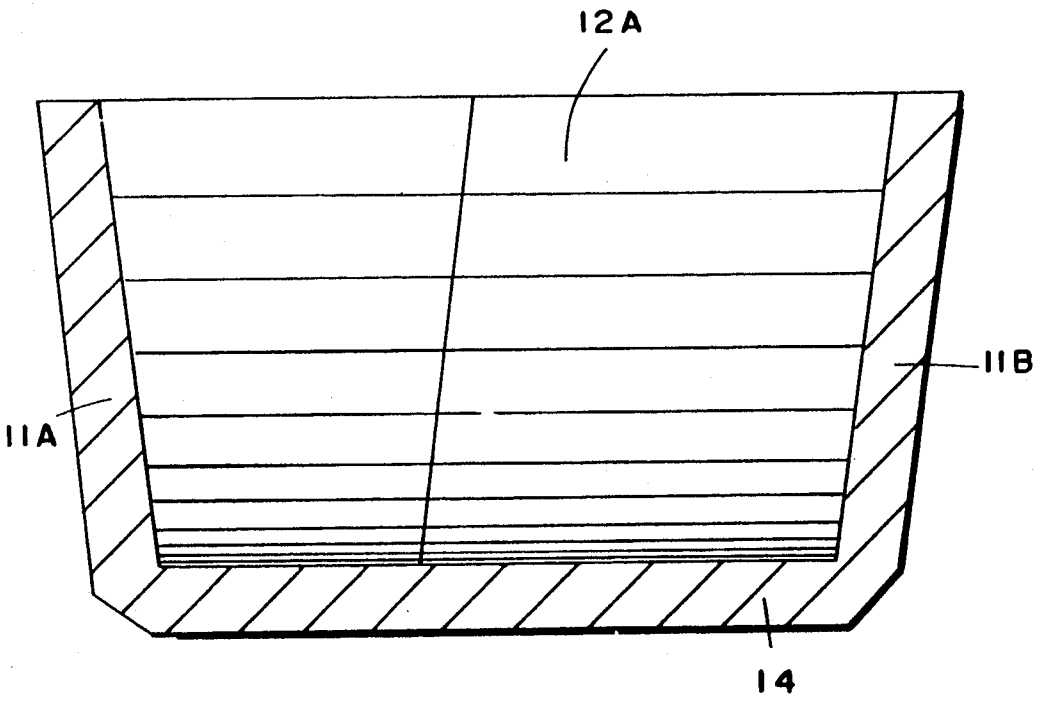
FIG. 4 is a section on line IV—IV of FIG. 1.
Figure 3:
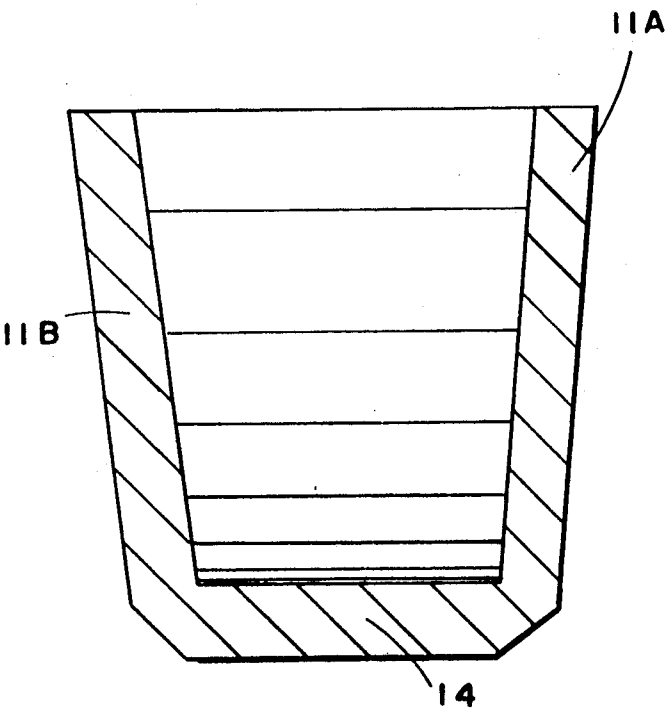
FIG. 3 is a section on line III—III of FIG. 1.

As is clearly shown in the sectional views of FIGS. 2, 3 and 4, the walls of the tundish are inclined outwardly as they rise from the floor 14 of the tundish.

In order to line the tundish of FIGS. 1 to 4, by conventional means, a considerable number of preformed lining slabs are required together with wedges, braces and baffles. A typical conventional arrangement is shown in FIG. 5A in which the various pieces and the number of each one required is as follow:

| Reference Number | Type | Number Required |
|---|---|---|
| 21 | impact pad | 1 |
| 22 | tail end wall | 1 |
| 23 | tail side wall | 1 |
| 24 | tail side wall | 1 |
| 25 | floor | 1 |
| 26 | floor | 1 |
| 27 | floor | 1 |
| 28 | floor | 2 |
| 29 | floor | 2 |
| 30 | end wall | 2 |
| 31 | longitudinal side wall | 2 |
| 32 | longitudinal side wall | 2 |
| 33 | longitudinal side wall | 4 |
| 35 | longitudinal side wall | 2 |
| 36 | longitudinal side wall | 1 |
| 37 | T-brace | 1 |
| 38 | longitudinal side wall | 1 |
| 39 | longitudinal side wall | 1 |
| 40 | longitudinal side wall | 1 |
| 41 | longitudinal side wall | 1 |
| 42 | brace | 4 |
| 43 | baffle | 1 |
| 44 | baffle | 1 |

Thus, there is a total of 35 separate pieces requiring careful fitting.

Figure 5B:
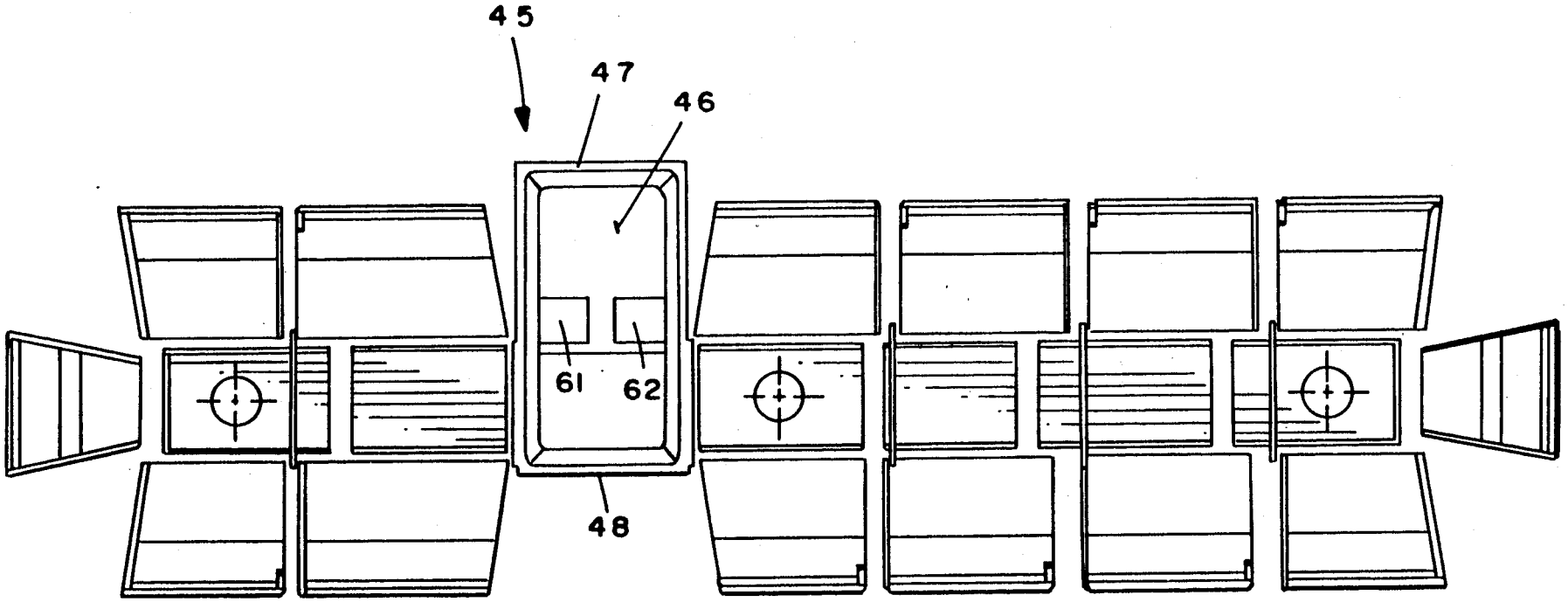
FIG. 5B shows the assembly of pieces—including a one-piece liner assembly—needed for lining the tundish of FIG. 1 according to the invention.

In the embodiment of the invention illustrated in FIG. 5B, eleven of these pieces in the pour region or junction region of the T-shaped tundish are replaced by a single one-piece liner assembly 45 with integral baffles. The separate pieces of FIG. 5A that are so replaced are one each of pieces numbers 21, 22, 23, 24, 26, 36, 37, 38, 39 and baffles 43 and 44. The one-piece replacement 45 has the following portions, as visible in FIG. 5B and as shown most clearly in FIGS. 6A–6D:

| | |
|---|---|
| 46 | floor and impact pad |
| 47 | tail end wall portion |
| 48 | longitudinal side wall portion (facing opposite portion 47) |
| 49, 50 | combined tail side walls and baffles. |

The combined tail side wall and baffle pieces 49, 50 are of erosion resistant material and each have an impervious portion 53 and 54, respectively to line the side walls of the tail of the "T", and a baffle portion 51 and 52 (flow control device) respectively. Baffle portions 53 and 54 are provided with a series of holes 55, 56, respectively to allow metal to flow through the baffles and they extend across the transverse width of the tundish, i.e. between its walls 11A and 11B. Note that a number of holes 55, 56 are not horizontal, but rather slope upwardly from inside the assembly 45 out, the closer the holes are to the bottom 46, the larger the degree of slope, e.g. up to about 50°.

Figure 6A:
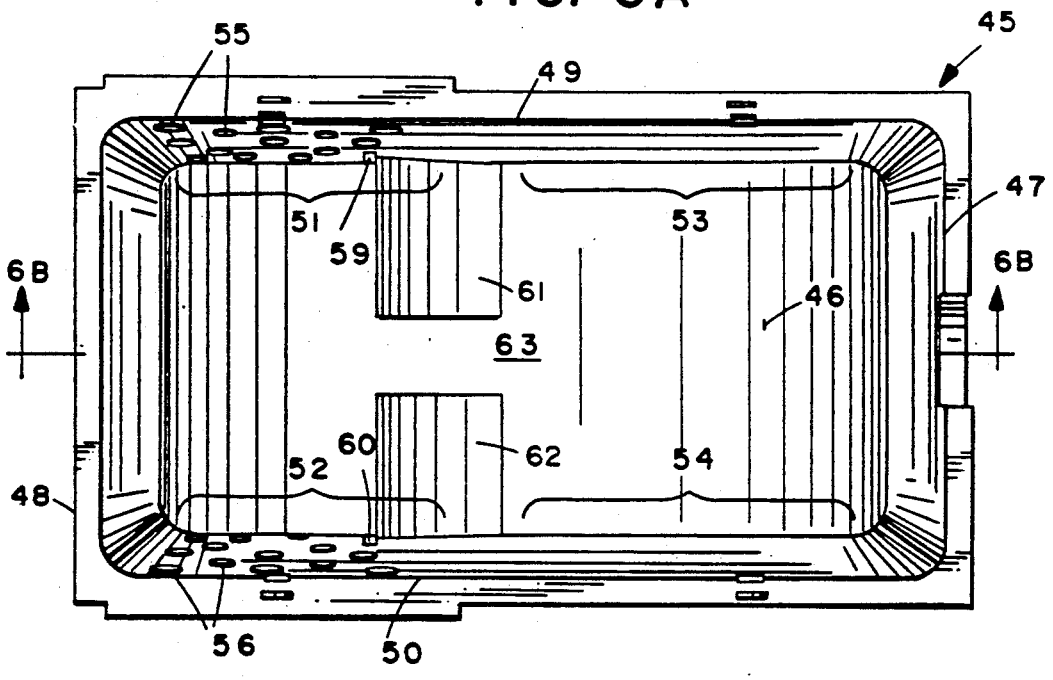
FIGS. 6A–D show a one-piece assembly of the invention for the pour region of the tundish of FIG. 1, FIG. 6A being a top plan view, FIG. 6B a cross-sectional view taken along lines 6B–6B of FIG. 6A, FIG. 6C a side view, and FIG. 6D a cross-sectional view taken along lines 6D—6D of FIG. 6C.
Figure 6B:
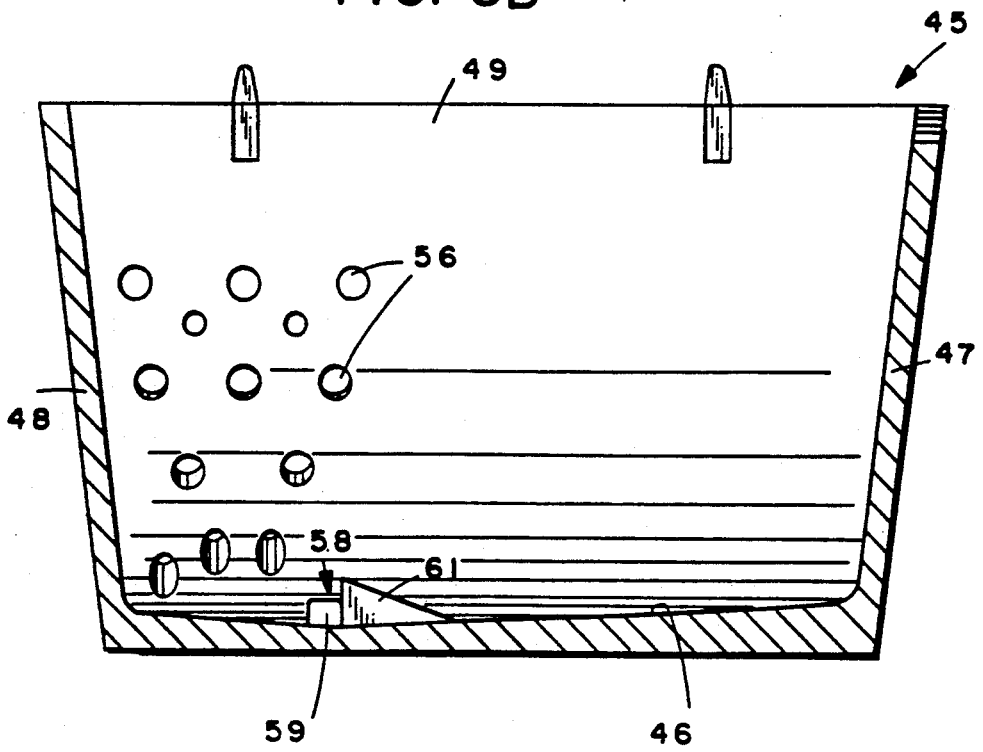
Figure 6C:
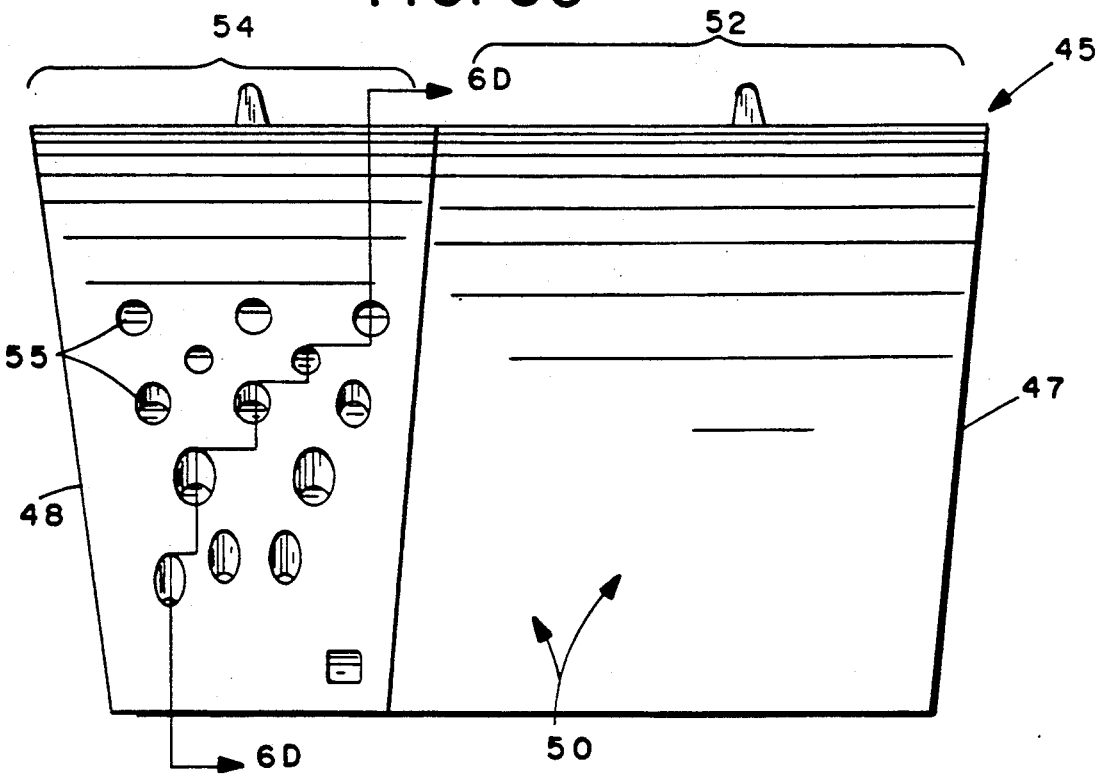
Figure 6D:
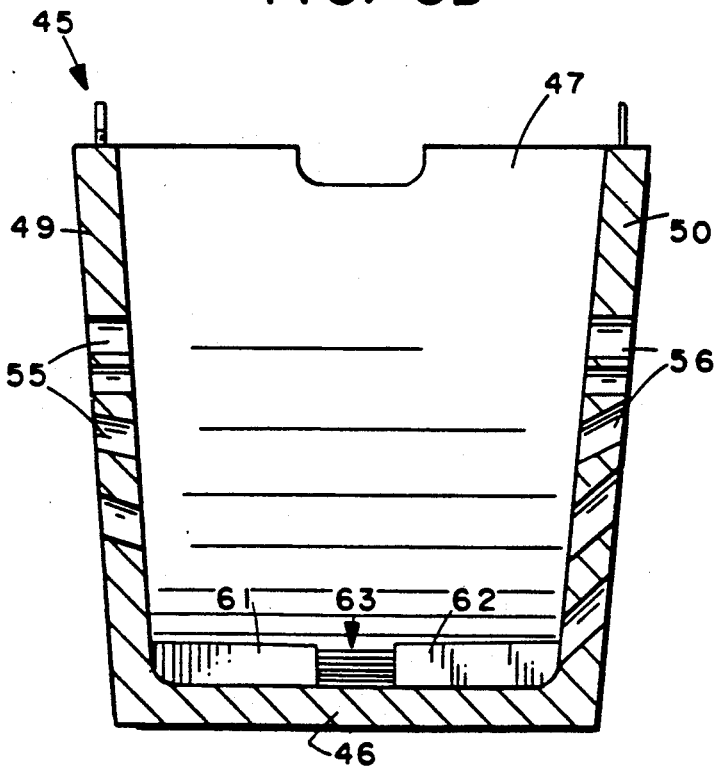

As seen most clearly in FIGS. 6A, 6B and 6D, the bottom 46 of the assembly 45 may slope from the end walls 47, 48 downwardly to a low point 58 within the volume defined by the baffle portions 51, 52. Located at the low point 58 are openings 59, 60 to drain the molten metal. In order to prevent short circuiting of the molten metal fed into the assembly 45 during casting, the ramps 61, 62 are provided. The ramps 61, 62 divert the molten metal away from direct passage through drain openings 59, 60. The ramps 61, 62 typically have a space 63 therebetween.

The assembly 45 is preferably cast as one piece for a high density refractory, e.g. about 60–70% alumina low moisture, low cement, high density, erosion resistant, castable refractory material. The materials heretofore described in the Background portion may be utilized as part of such a material, or in lieu thereof.

Figure 7:
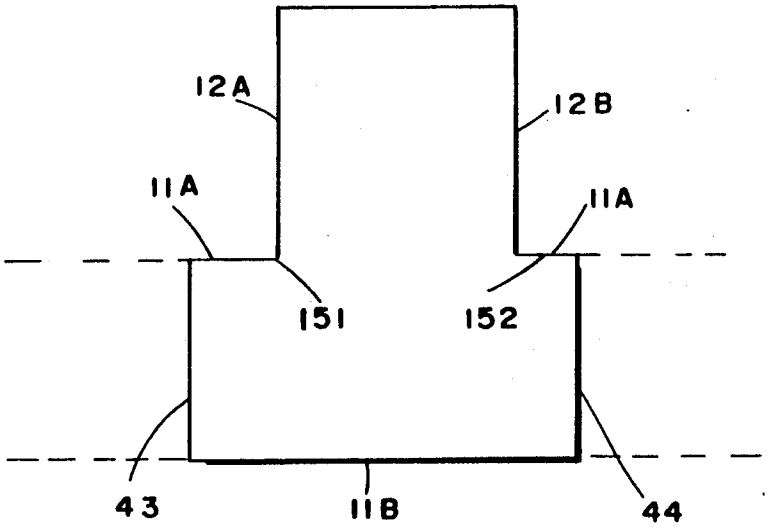
FIG. 7 PRIOR ART
FIG. 7 is a schematic plan view of the pour area of a lined version of the tundish of FIG. 1 using a conventional, prior art, lining.

FIG. 7 schematically shows the location of baffles adjacent the pour region in a conventionally-lined (prior art) tundish. Because of the inclination of walls 11A, 11B and 12A, 12B it is necessary to fix baffles 43 and 44 some distance away from the respective junctions or corners 151 and 152 of these walls. These corners are subject to severe erosion as molten metal passes around them to flow through baffles 43 and 44.

Figure 8:
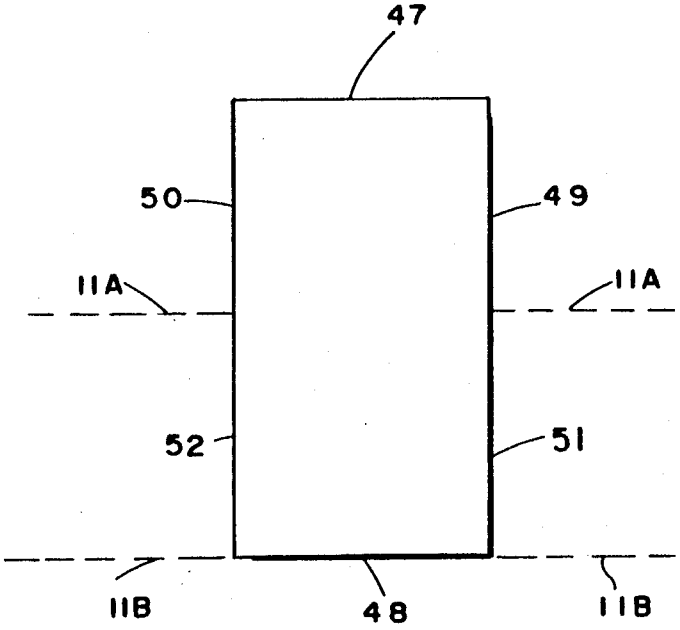
FIG. 8 is a schematic plan view of the pour area of a lined tundish using an integrally-formed lining and flow-control device of the invention.

FIG. 8 schematically shows the simplified and greatly improved configuration achieved using the one-piece replacement 45 of the invention. Baffle portions 51, 52 are a continuation of side walls 49, 50 respectively and the corners 51 and 52 of FIG. 7 are eliminated.

Thus, it can be seen that the invention not only reduces the separate number of preformed pieces required to be made and fitted, it reduces unwanted erosion by enabling a better designed integral lining (45), with integrally formed flow control device (baffle portions 51, 52) to be used.

FIGS. 9A–9D illustrate a second embodiment of a flow control containing integral lining assembly 70 according to the invention. The assembly 70 contains a dam-weir combination as the flow control device, and is also preferably of a cast, high density, erosion resistant refractory (like the assembly 45).

The major components of the assembly 70 are the bottom/impact pad 71, the top end walls 72 forming weirs 73, the bottom, end walls (lips) 74 forming dams 75, and side walls 76. Projections 77 are provided to allow ready lifting of assembly 20 by a crane or the like. An exemplary positioning of the assembly 70 in a conventional trough shaped tundish 80 (at the pour section thereof) is illustrated in FIG. 10. The rest of the tundish 80 may be lined with conventional consumable, expendable boards (such as seen in FIG. 5A), or coated with a conventional spray coating such as "TUNCAST" (marketed by Foseco, Inc. of Cleveland, Ohio).

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A discrete preformed expendable refractory lining for disposition in a metallurgical vessel, the discrete preformed lining being integrally-formed, prior to disposition in the vessel, in one-piece to have a floor portion, wall portions and at least one integrally-formed flow control device, the lining having a refractory composition throughout.

2. A lining according to claim 1, wherein the integral floor portion includes an erosion-resistant impact pad to receive molten metal poured into the vessel.

3. A lining according to claim 1, wherein said flow control device comprises at least one upright erosion resistant baffle with apertures for the passage of molten metal.

4. A lining according to claim 3 wherein baffle apertures closer to the floor portion form a larger angle with respect to the horizontal than those more remote from the floor portion, said baffle apertures being provided in a sequence of apertures with different angles at at least three different heights.

5. A lining according to claim 1, in combination with a tundish.

6. A combination according to claim 5, wherein the tundish is of generally T-shape plan having a T-junction, and the integral lining is a partial lining to cover the tundish walls and floor in the pour region, adjacent the T-junction.

7. A lining according to claim 1, which is formed from a mixture of refractory fibers, refractory fillers and binder, the fibers being selected from the class consisting essentially of calcium silicate and aluminum silicate fibers, the fillers being selected from the class consisting essentially of silica, alumna, magnesia and refractory silicate, and the binder being selected from the group consisting essentially of colloidal silica sol, starch, phenol-formaldehyde resin and urea-formaldehyde resin.

8. A lining according to claim 7, in which the filler is a mixture of magnesia and particulate olivine.

9. A lining according to claim 1 formed of about 60–70% alumina low moisture, low cement, high density, erosion resistant, castable refractory material.

10. A lining according to claim 1, wherein said at least one integrally-formed flow control device is a dam or weir.

11. A lining according to claim 1 wherein said lining includes integrally formed dams and weirs as flow control devices.

12. A discrete preformed expendable refractory liner for disposition in a tundish having a pour region, the discrete liner being integrally formed, prior to disposition in the tundish, in one piece to include a floor corresponding to the pour region of the tundish, walls corresponding to two opposed walls of the tundish adjacent the tundish pour region, and at least one flow control device extending substantially at right angles to said opposed walls, the lining having a refractory composition throughout.

13. A liner according to claim 12 formed of about 60–70% alumina low moisture, low cement, high density, erosion resistant, castable refractory material.

14. A liner according to claim 12, wherein said at least one integrally-formed flow control device is a dam or weir.

15. A liner according to claim 12, in wherein said flow control device comprises at least one upright erosion resistant baffle with apertures for the passage of molten metal.

16. A liner as recited in claim 12 wherein said tundish is T-shaped.

17. A liner as recited in claim 12 wherein said tundish is trough shaped.

18. A discrete preformed expendable refractory lining in combination with a tundish of generally "T" shape in plan, the tundish having a longitudinally extending main body portion and a shorter portion corresponding to the tail of the "T", the shorter portion extending substantially at right angles to the main body portion, the lining being integrally formed prior to disposition in the vessel and comprising a floor portion and four walls, the floor portion including a pour region to receive molten metal poured into the tundish, a first wall corresponding to the base of the tail of the "T", a second wall corresponding to the portion of the tundish wall directly opposed to said first wall, and third and fourth walls facing each other and extending between said first and second walls, the third and fourth walls having baffle portions which are provided with an array of apertures, the baffle portions extending across the transverse with of the longitudinal body portion of the tundish.

19. A combination according to claim 18 wherein said lining comprises about 60–70% alumina low moisture, low cement, high density, erosion resistant castable refractory material.

20. A discrete preformed expendable refractory lining in combination with and for fitting within a trough shaped tundish having a pour area, the discrete lining being entirely integrally formed prior to fitting within said tundish of substantially refractory material throughout, including a floor portion and walls, and at least one flow control device built integrally therein, said discrete lining being dimensioned to fit within the trough shaped tundish covering the pour area with the flow control devices controlling flow from the preformed lining to other areas of the tundish not lined by said preformed lining.

21. A combination as recited in claim 20 wherein said flow control devices of said lining comprise two dams and two weirs, horizontally spaced from each other.

22. A combination as recited in claim 21 wherein said preformed expendable lining comprises a bottom pad having end wall lips which form said dams, and top end walls and side walls, the top end walls having bottom edges which form said weirs, the weir-forming bottom edges being disposed vertically below the dam forming lips.

23. A combination as recited in claim 18 wherein said lining has substantially the same composition throughout.

* * * * *